US006832817B1

(12) United States Patent
Chiu

(10) Patent No.: US 6,832,817 B1
(45) Date of Patent: Dec. 21, 2004

(54) BALL CHAIR

(76) Inventor: Ciber Chiu, No. 54-6, Chipan Lane, Lukang Chen, Chuanghua Hsien (TW)

( * ) Notice: Subject to any disclaimer, the term of this patent is extended or adjusted under 35 U.S.C. 154(b) by 0 days.

(21) Appl. No.: 10/781,992

(22) Filed: Feb. 19, 2004

(51) Int. Cl.[7] ..... A47C 7/02

(52) U.S. Cl. ..... 297/452.41; 16/43; 248/188.8; 248/188.9

(58) Field of Search ..... 297/452.41, DIG. 3, 297/217.1, 195.11, 440.1; 5/654; 16/39, 43; 248/188.8, 188.9, 188.1

(56) References Cited

U.S. PATENT DOCUMENTS 1,929,743 A * 10/1933 Jarvis, et al. ..... 16/43
2,992,449 A * 7/1961 Haydock ..... 16/43
3,452,386 A * 7/1969 Carlson ..... 248/188.9
3,869,105 A * 3/1975 Daniels ..... 248/188.8
4,327,461 A * 5/1982 Wisniewski ..... 248/188.9
5,690,389 A * 11/1997 Ekman et al. ..... 297/452.41
6,070,943 A * 6/2000 Guery-Strahm ..... 297/452.41
6,447,070 B1 * 9/2002 Ekman et al. ..... 297/452.41
6,520,578 B1 * 2/2003 Jospa et al. ..... 297/452.41
D471,025 S * 3/2003 Chiu ..... D6/366
D471,371 S * 3/2003 Chiu ..... D6/366
6,616,238 B1 * 9/2003 Guery-Strahm ..... 297/452.41

* cited by examiner

*Primary Examiner*—Peter R. Brown
(74) *Attorney, Agent, or Firm*—William E. Pelton, Esq.

(57) ABSTRACT

A ball chair with a securing device has a seat (10) with a backrest (14), a ball-shaped cushion (20), a guard rod (30) holding the ball-shaped cushion (20) with the backrest (14), multiple strengthening blocks (40) attached under the seat (10), and multiple legs attached to the seat (10) by the multiple strengthening blocks (40). Each strengthening block (40) is non-hollow to provide an anti-crack efficiency to joints connected to the legs. Additionally, a cone-shaped post is clamped between one strengthening block (40) and one corresponding leg to adjust a total height of the ball chair.

8 Claims, 5 Drawing Sheets

BALL CHAIR

BACKGROUND OF THE INVENTION

1. Field of the Invention

The present invention relates to a ball chair, and more particularly to a ball chair having multiple strengthening blocks at joints of the ball chair to avoid the ball chair cracking at the joints.

2. Description of Related Art

A conventional ball chair is composed of a chair and a ball-shaped cushion. The chair has a seat plate with a top face and a bottom face. A partly-spherical passage is defined in the top face of the seat plate to receive a lower portion of the ball-shaped cushion inside. At least three legs are attached to the bottom face of the seat plate to support the ball chair. By placing the ball-shaped cushion in the partly-spherical passage of the chair, a ball chair is achieved. However, when a user sits in the ball chair, the ball-shaped cushion is pressed to deform forward and then falls out of the partly-spherical passage such that the user easily falls from the ball chair. Additionally, when the ball chair is bumped or vibrated, the ball-shaped cushion rebounds and easily springs out of the partly-spherical passage. Therefore, a backrest or a guard securing means is attached on the top face of the seat plate to hold the ball-cushion in place. However, with regard to the seat plate, it is usually made of plastic by blow molding and thus is a hollow body that is easily broken, especially at joints between the seat plate and the legs. Therefore, the ball chair is not safe and not stable for the user.

Additionally, the ball chair has a constant height and can not satisfy tall people so that the ball chair is limited to be only suitable for people of a certain height.

The present invention has arisen to mitigate or obviate the disadvantages of the conventional ball chair.

SUMMARY OF THE INVENTION

The main objective of the present invention is to provide a ball chair with strengthening blocks that avoid a seat cracking at joints where multiple legs are attached, whereby, the ball chair is safe and steady.

Another main objective of the present invention is to provide a ball chair further having a detachable post attached between the seat and the leg to adjust the height of the ball chair.

Further benefits and advantages of the present invention will become apparent after a careful reading of the detailed description with appropriate reference to the accompanying drawings.

BRIFF DFSCRIPTION OF THE DRAWINGS

DETAILED DESCRIPTTON OF THE PREFERRED EMBODIMENT

Figure 1:
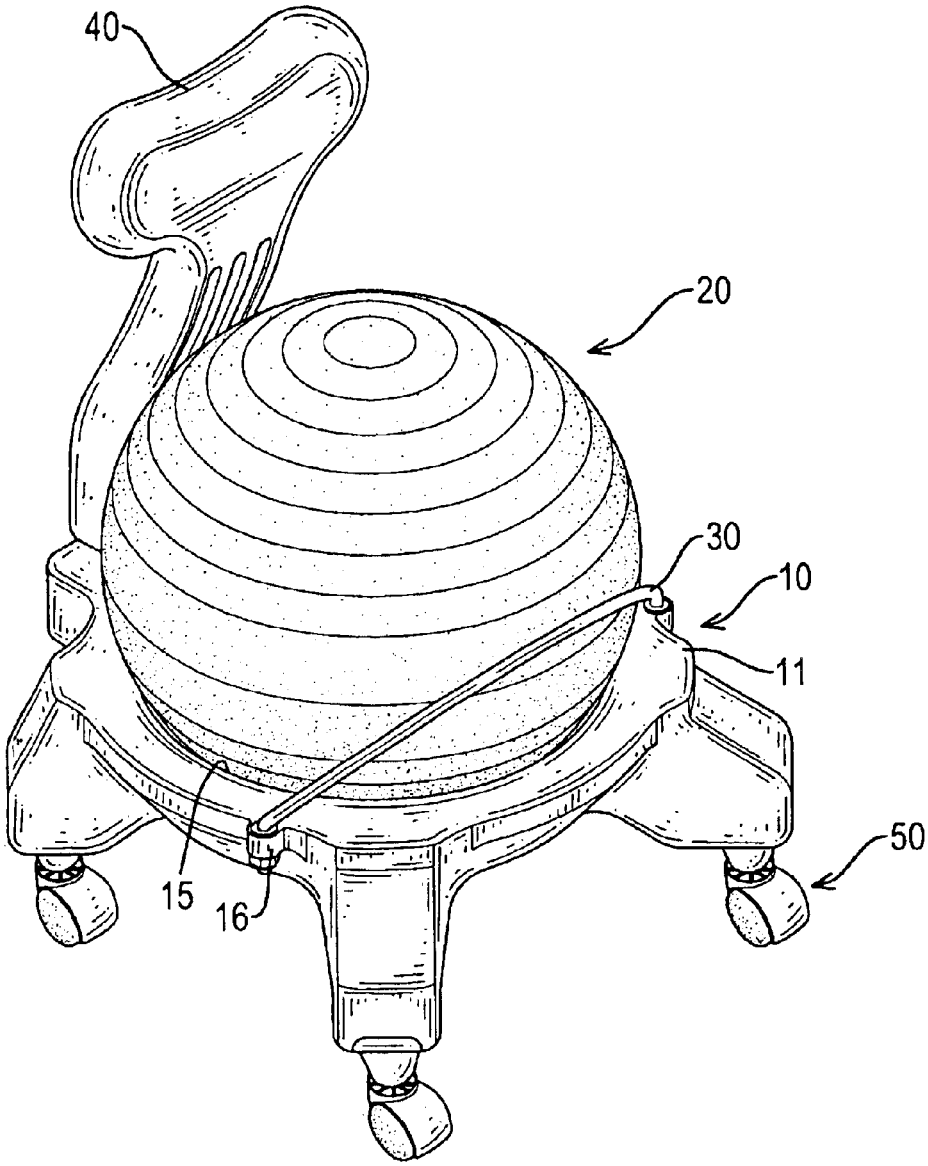
FIG. 1 is a perspective view of a ball chair with securing devices in accordance with the present invention.
Figure 2:
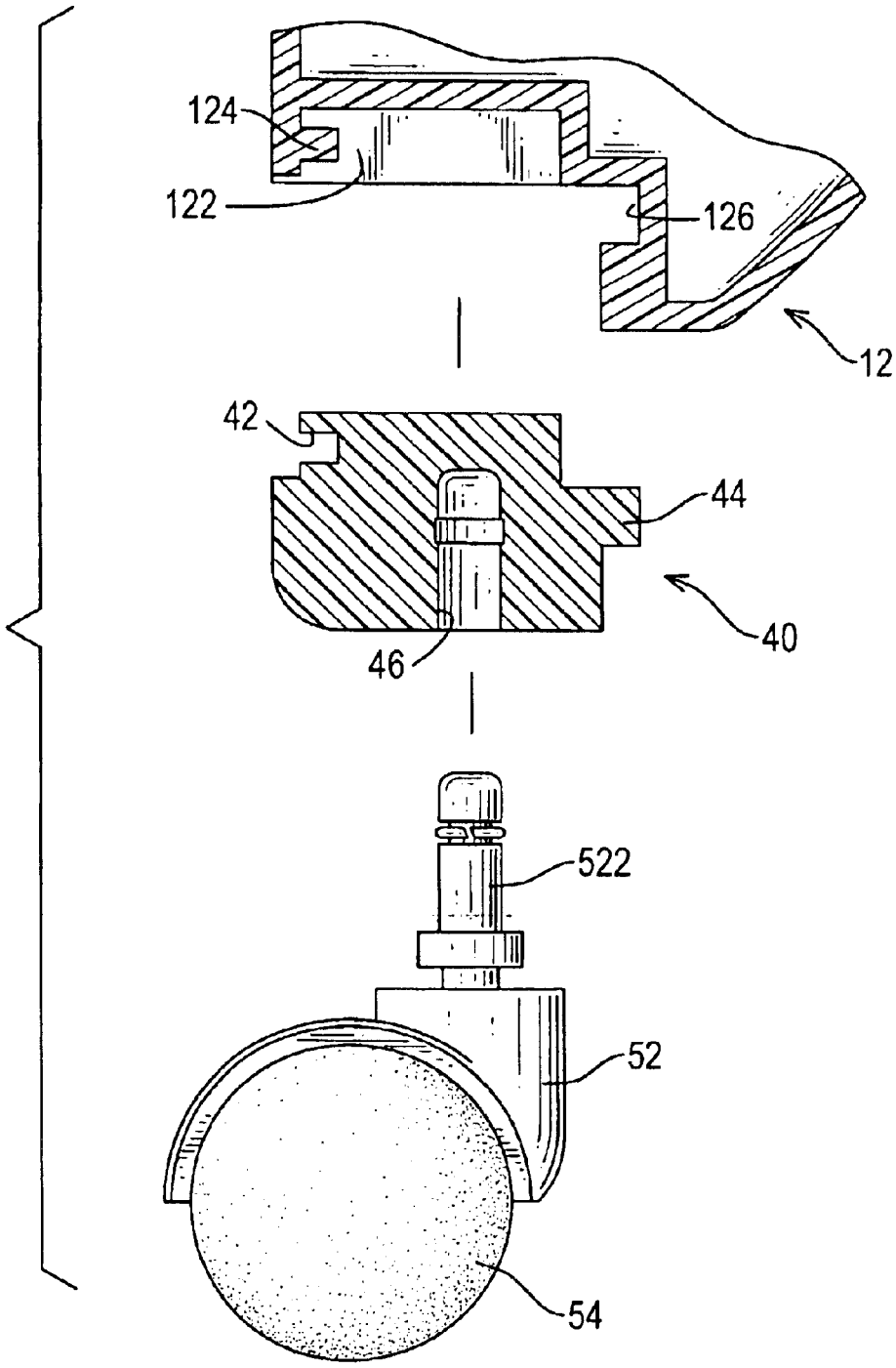
FIG. 2 is a side plane view in partially exploded section of a joint of one leg of the ball chair in FIG. 1.

With reference to FIGS. 1 and 2, a ball chair in accordance with the present invention comprises a seat (10), a ball-shaped cushion (20), a securing device (30), multiple strengthening blocks (40), and multiple legs.

The seat (10) has a seat plate (not numbered) with a top face (111), a bottom face (not numbered), a front edge, and a rear edge, and has multiple extending portions (12), a dished passage (15) extending from the top face (11) to the bottom face, and a backrest (14). The multiple extending portions (12) extend from the bottom face of the seat plate to support the seat plate and each extending portion (12) has a distal end with a block recess (122) defined in the distal end. The block recess (122) has an inner periphery and a tooth (124) formed on the inner periphery at one side and a mortise (126) defined in the inner periphery at the other side. The backrest (14) upwardly extends from the rear edge of the seat plate to adapt to support a user's back.

The ball-shaped cushion (20) is made of resilient bladder and has a maximum diameter slightly larger than a maximum diameter of the passage (15) and a minimum diameter smaller than a minimum diameter of the passage (15), thus the ball-shaped cushion (20) rests on the seat plate such that a lower portion of the ball-shaped cushion (20) can protrude from the passage (15). Optionally, two connecting ears (16) are respectively formed on opposite sides of the front edge of the seat plate for engaging with the securing device and each ear (16) has a through hole (not numbered).

The securing device (30) is attached to the front edge of the seat plate and is a guard rod made of rigid material such as plastic rod, metal rod etc. The guard rod has a main portion (not numbered) that is preferably curved and two end pieces somewhat perpendicular in a same direction to the main portion. Each end piece extends through the through holes to secure the guard rod to erect at the front edge of the seat (10). Thereby, the guard rod (30) holds at an upper portion in comparison with the lower portion of the ball-shaped cushion (20) in cooperation with the backrest (14) and the seat (10) to avoid the ball-shaped cushion (20) falling off from the seat (10), even when the ball chair vibrates.

The multiple strengthening blocks (40) are respectively received inside the multiple block recesses (122) of the extending portions (12). Each strengthening block (40) is substantially a non-hollow hexahedron and has a bottom face and an outer periphery mated with the inner periphery of the corresponding block recess (122). A tooth dent (42) is defined in the outer periphery at one side corresponding to the tooth (124) inside the block recess (122) and a wedge (44) is formed at an opposite side corresponding to the mortise (126) inside the block recess (122). Additionally, an insertion hole (46) is defined in the bottom face of the strengthening block (40).

Figure 3:
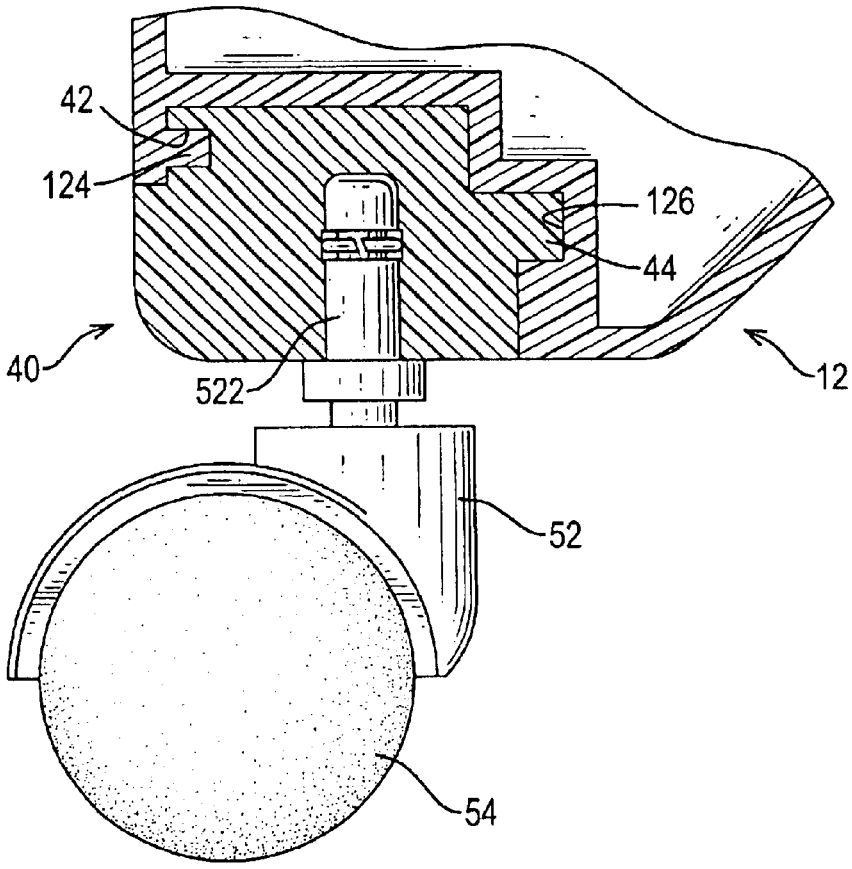
FIG. 3 is a side plane view in partially assembled section of the joint of the leg in FIG. 2.

The multiple legs are respectively attached on the strengthening blocks (40) and are preferable wheel assemblies (50). Each wheel assembly (50) comprises a wheel rack (52) with a top insertion (522) and wheel (54) rotatably mounted under the wheel rack (52). With further reference to FIG. 3, by wedging the top insertion (522) into the insertion hole (46) of the strengthening block (40), the wheel assembly is firmly combined with the seat (10) to allow the ball chair to be moved easily.

Figure 4:
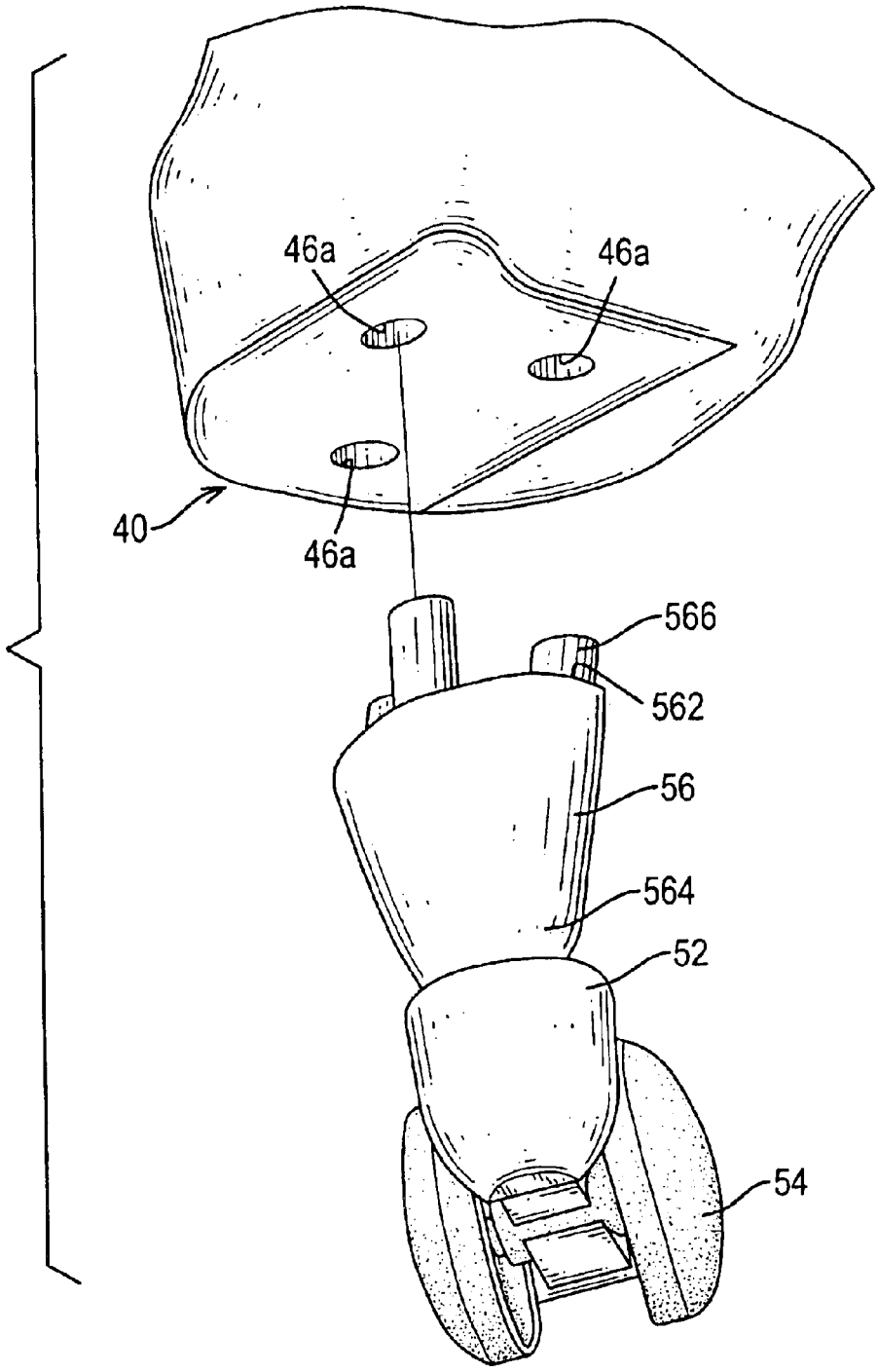
FIG. 4 is a perspective view of another embodiment of the ball chair, wherein an extending post is secured between a seat and a wheel.
Figure 5:
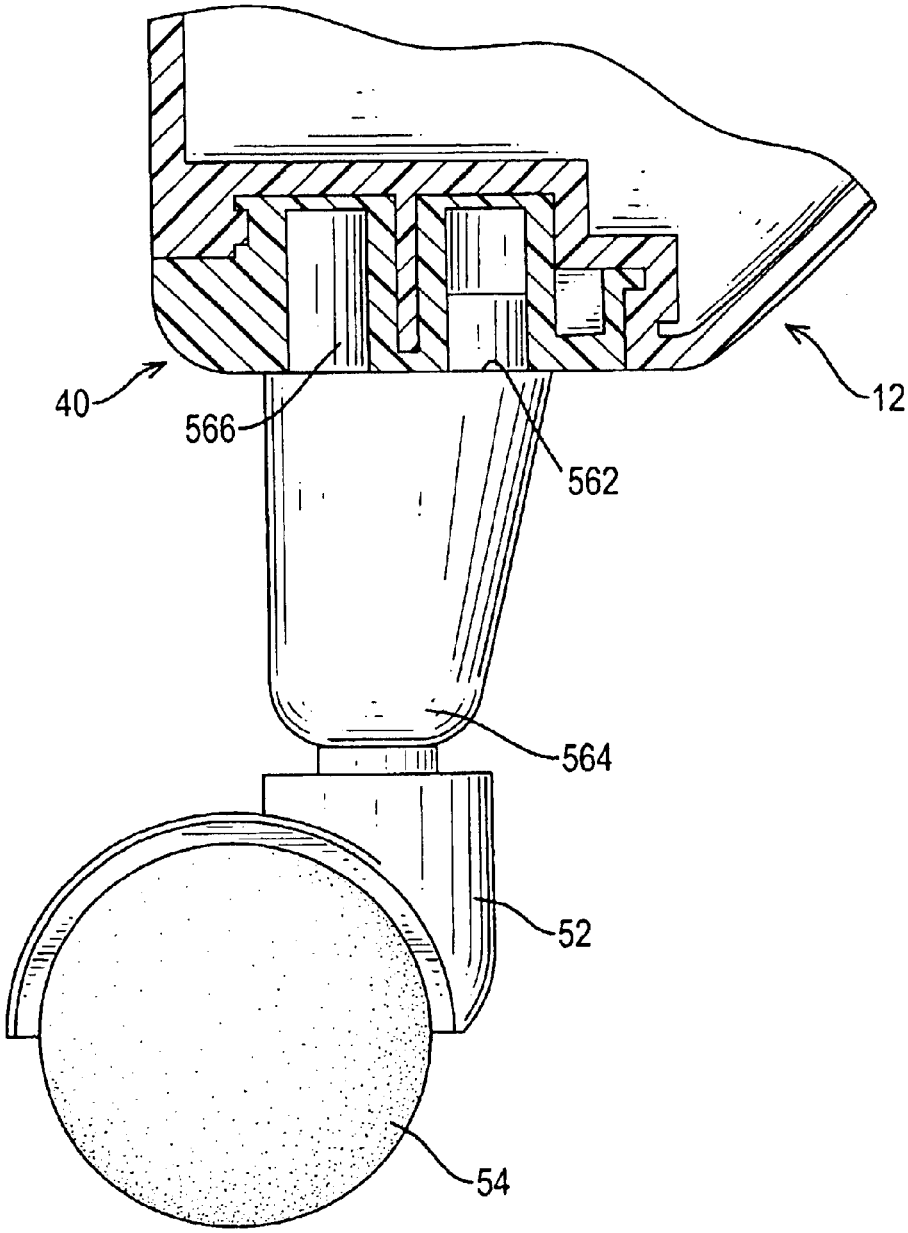
FIG. 5 is a side plane view in partially assembled section of the embodiment of the ball chair in FIG. 4.

With reference to FIGS. 4 and 5, another embodiment of the leg is that the wheel assembly further has a post (56) clamped between the strengthening block (40) and the wheel rack (52). The post (56) is cone-shaped and has an enlarged flat head (562) and a tapered point head (564). Three positioning insertions (566) are formed on the enlarged flat head (562) to extend upward. Correspondingly, the strengthening block (40) has three insertion holes (46*a*) defined in the bottom face to respectively mate with the positioning insertions (566). The tapered point head (564) also has an insertion hole (not shown) to engage with the insertion (522) of the wheel rack (52). The post (56) increases a total height of the ball chair and three positioning insertions (566) provide positioning efficiency at multiple points to keep the ball chair stable when the gravity of the ball chair rises with the increased total height.

When a user sits on the ball chair, the ball-shaped cushion (20) is pressed to deform and biased to the front edge of the seat (10). The guard rod (30) stops the ball-shaped cushion (20) from further deforming to avoid the malpositioning of the ball-shaped cushion (20), which may otherwise cause the user fall from the ball chair. The non-hollow strengthening block (40) made of plastic engages with the wheel rack (52) directly or with the post (56) and sustains the pressure at joints because the strengthening block (40) is not hollow. Thus, the ball chair is safe and stable. Additionally, the strengthening block (40) can be preset inside the extending portion (12) when the seat (10) is produced by means of blow molding.

Although the invention has been explained in relation to its preferred embodiment, it is to be understood that many other possible modifications and variations can be made without departing from the spirit and scope of the invention as hereinafter claimed.

What is claimed is:

1. A ball chair comprising:

a seat (10) having a seat plate with a top face (11), a bottom face, a front edge, and a rear edge;

multiple extending portions (12) attached to the bottom face of the seat plate to support the seat plate;

a passage (15) defined in the top face (11) of the seat plate; and a backrest (14) upwardly extending from the rear edge of the seat plate;

a ball-shaped cushion (20) made of resilient bladder and partially received inside the passage (15) to rest on the seat (10);

a securing device composed of a guard rod (30) with two ends (31) erecting at the front edge of the seat plate to hold the ball-shaped cushion (20) with the backrest (14) and the seat plate; and multiple legs respectively attached under the extending portions (12) of the seat (10);

wherein the improvement of the ball chair comprises:

multiple non-hollow strengthening blocks (40) respectively clamped between the extending portions (12) and the legs.

2. The ball chair as claimed in claim 1, wherein each extending portion (12) has a distal end; and a block recess (122) defined in the distal end and having an inner periphery, a tooth (124) formed at one side on the inner periphery, and a mortise (126) defined at another side opposite to the tooth (124) in the inner periphery; and each strengthening block (40) is a hexahedron and has a bottom face, an outer periphery mated with the inner periphery of the corresponding block recess (122), a tooth dent (42) defined in the outer periphery to correspond to the tooth (124) inside the block recess (122), and a wedge (44) formed on the outer periphery to correspond to the mortise (126) inside the block recess (122).

3. The ball chair as claimed in claim 2, wherein the multiple legs are wheel assemblies (50), each wheel assembly (50) comprises a wheel rack (52) with a top insertion (522) and a wheel (54) rotatably mounted under the wheel rack (52);

an insertion hole (46) is defined in the bottom face of each strengthening block (40) to engage with the top insertion (522) of a corresponding wheel assembly (50).

4. The ball chair as claimed in claim 3, wherein a post (56) is clamped between each strengthening block (40) and the wheel rack (52) of a corresponding one of the wheel assemblies (50).

5. The ball chair as claimed in claim 2, wherein a post (56) is clamped between each strengthening block (40) and a corresponding one of the legs.

6. The ball chair as claimed in claim 5, wherein each post (56) is cone-shaped and has an enlarged flat head (562) and a tapered point head (564);

three positioning insertions (566) are formed on the enlarged flat head (562);

wherein, each strengthening block (40) has three insertion holes (46*a*) defined in the bottom face to respectively mate with the three positioning insertions (566) of a corresponding one of the posts (56).

7. The ball chair as claimed in claim 1, wherein a post (56) is clamped between each strengthening block (40) and a corresponding one of the legs.

8. The ball chair as claimed in claim 7, wherein each post (56) is cone-shaped and has an enlarged flat head (562) and a tapered point head (564);

three positioning insertions (566) are formed on the enlarged flat head (562);

wherein, each strengthening block (40) has three insertion holes (46*a*) defined in the bottom face to respectively mate with the three positioning insertions (566) of a corresponding one of the posts (56).

* * * * *